United States Patent [19]

David et al.

[11] Patent Number: 4,713,078

[45] Date of Patent: Dec. 15, 1987

[54] METHOD FOR PRESERVING RAW HIDES, SKINS AND FURSKINS

[75] Inventors: Dezso David; Peter Rovo; Terez Sipos nee Richter; Gyorgy Molnar; Istvan Deme; Tamas Karnitscher, all of Budapest, Hungary

[73] Assignees: Bor-es Cipoipari Kutato-Fejleszto Vallalat; Budapesti Boripari Vallalat, both of Budapest, Hungary

[21] Appl. No.: 849,702

[22] Filed: Apr. 9, 1986

[30] Foreign Application Priority Data

Apr. 10, 1985 [HU] Hungary ..... 1313/85

[51] Int. Cl.[4] ..... C14C 1/00

[52] U.S. Cl. ..... 8/94.15

[58] Field of Search ..... 8/94.1 R, 94.15; 252/8.57

[56] References Cited

U.S. PATENT DOCUMENTS 3,734,684 5/1973 Donaldson et al. ..... 8/183

*Primary Examiner*—Paul Lieberman
*Assistant Examiner*—John F. McNally
*Attorney, Agent, or Firm*—Keil & Weinkauf

[57] ABSTRACT

The invention relates to a method for preserving raw hides, skins and furskins comprising treating the hides, skins and furskins with an aqueous solution containing at least 0.1% by mass of cyanamide and, if desired, one or more members of the group consisting of polyalcohols, fungicides, sodium chloride, buffer systems possessing buffer capacity in acidic media, salts capable of acidic hydrolysis, weak acids and surface active agents.

The raw hides, skins and furskins can be stored without of appearance of any sign of deterioration for at least two weeks in humid ambient conditions.

4 Claims, No Drawings

METHOD FOR PRESERVING RAW HIDES, SKINS AND FURSKINS

This invention relates to a method for treating raw hides, skins and furskins to prevent deterioration of the hides or skins. The method can be applied on its own after flaying for short or long term preservation, or can be combined with the known preservation methods.

It is known that the freshly flayed animal hides and skins are generally not processed immediately by the tanneries. At ambient temperatures the raw hides and skins—being favourable substrates for micro-organisms—begin to putrefy and soon become useless for processing into leather. Freshly flayed hides and skins, therefore, need to be treated in some way in order to prevent deterioration.

In principle, the preservation can be attained in two ways:

- by destroying the micro-organisms or at least considerably reducing their population,
- by creating conditions that are unfavorable for the metabolism of the microorganisms.

A good preservation method should be

- cheap,
- simple,
- reversible and
- free from unwanted side effects.

The classical methods of raw hide and skin preservation, namely salting and drying, are based on a dehydration effect. They protect the raw material by reducing its moisture content since the micro-organisms need a certain amount of moisture for their activity.

For satisfactory cure the moisture content should be between 40 and 48%, based on the hide weight, and the remaining water should contain dissolved sodium chloride in an amount of at least 90% of saturation. Hides with 45% moisture and 13% salt content can be stored for about one month, with 15% salt content the protection period extends to about six months (B. M. Haines, JALCA, 79, 319/1984/). Naturally, in order to obtain salt contents like these successive treatments with two or three times more salt on the whole are necessary. It is interesting to note that there is not much difference between the amounts of salt necessary for short (one month) and long term (over six months) protection.

During the last 15 years there has been a constantly growing need for new preservation methods, as it can clearly be seen in the respective literature. The elimination or reduction of salt treatment is important for several reasons:

- the preservation requires a large amount of salt (30 to 60%, based on the weight of the untreated raw hides and skins). Therefore, the packing house and tannery effluents are heavily polluted by dissolved salt, which can not be removed economically for the time being,
- the used salt is declared "dangerous waste" in several countries,
- at salt contents even above 50% saturation certain salt tolerant (halophilic) bacteria can survive and cause damage to the raw material,
- considerable amounts of raw hides and skins are usually processed within a few weeks after flaying but the amount of salt necessary for short term preservation is not much less then that required for long term protection.

Preservation by drying is generally employed in the tropical countries and often without any preliminary treatment. During the first few days, while the hides and skins still have a high moisture content, they suffer considerable microbial deterioration unless they are pretreated with a suitable preservative.

Instead of reducing the moisture content, the recent efforts have concentrated on the application of various chemicals that are toxic to the micro-organisms. Elliot, R. G. H. published several procedures for reducing the bacterial population on raw hides and skins in this way (paper presented at the VIIth Congress on the Leather Industry, Budapest, 1982):

in England the deterioration of raw hides and skins was delayed by spraying aqueous solution of biguanidine hydrochloride onto the flesh side. Unwashed raw hides and skins are protected in this way for about two days, which can be increased up to seven days by a previous washing;

in New Zealand boric acid is used for short term preservation, a saturated solution of which results in a storability of five days and by adding naphthalene it can be prolonged by a few days more;

sodium sulphite, sodium bisulphite or their mixture with acetic acid were also used in large scale preservation. A treatment with 1 to 5% by mass of sodium sulphite results in about seven days storability.

A number of neutral or synthetic organic and inorganic chemicals have been tried for preservation. In the last five years several patents were granted in this field:

according to German patent specification No. 3,016,875 raw hides and skins are treated with sodium chloride solutions containing aluminium salts and other known preservatives; in Soviet patent specification No. 819,172 alkyl methyl benzyl ammonium chloride is added to sodium chloride; according to German patent specification No. 3,022,849 an inorganic zinc salt and chloroacetamide is used in the first step, followed by a treatment with sodium chloride and a divalent carboxylic acid; U.S. Pat. No. 4,224,028 recommends an aqueous solution of pH=9 to 11 containing a phosphate buffer, a fatty acid salt and ethyl alcohol whereby a storability of seven days could be attained.

Long term protection can only be achieved by the application of sodium chloride in amounts close to 50% by mass, based on the weight of the raw hides and skins. In the case of other preservatives--without combining them with sodium chloride—the storability amounts only to a few days.

Although a few-day protection can be very useful—because raw hides and skins begin to deteriorate within a very short time after flaying—, a storability of 2 to 6 weeks would be necessary in order to let the raw hides and skins be sorted into weight categories and transported into the tanneries.

Now we have found that raw hides, skins and furskins can be stored without the appearance of any sign of deterioration for at least two weeks in humid ambient conditions if they are treated with an aqueous solution containing at least 0.1 percent by mass of cyanamide and, if desired, one or more members of the following group:

- sodium chloride
- polyalcohols,
- fungicides,
- acidic buffer systems, salts capable of acidic hydrolysis, and weak acids,
- surface active agents.

Certain components of the composition—like sodium chloride—may be originally present in the raw hides and skins to be preserved.

Different methods can be applied to bring the composition into contact with the raw material (like soaking, soaking together with mechanical action, spraying, sprinkling of powder mixture, etc.). The preservative composition can be applied alone or with an inert carrier (like sawdust). The method can be advantageously combined with the known procedures: e.g. it is suitable for the preliminary preservation prior to drying.

The cured raw hides and skins can be processed in the tanneries with the usual technologies into end products of required quality.

The following examples are submitted for a better understanding of the invention, without limiting the scope claimed.

EXAMPLE 1

Freshly flayed, washed cattle hide pieces (total weight: 500 g) were put into a laboratory Wacker drum together with 125 $cm^3$ of tap water, 5 g of cyanamide and 50 g of sodium chloride. After 2 hours drumming at ambient temperature the excess float was dripped off and the pieces were stored at 20° to 30° C., properly wrapped in order to prevent drying out. A mild hairslip was observed on the 50th day and the characteristic odour of putrefaction appeared on the 65th day.

Carrying out the same process but leaving out the cyanamide, the hide pieces could be stored only for 14 days.

EXAMPLE 2

A freshly flayed, unwashed, manure-contaminated cattle hide piece was soaked for 5 minutes in an aqueous solution of 5% by mass of cyanamide, 2% by mass of boric acid, 0.1% by mass of Preventol CMK* and 0.5% by mass of nonylphenol polyglycol ether. After dripping off the excess solution the hide piece was stored as in Example 1. A mild hairslip was observed on the 54th day and the odour of putrefaction appeared on the 70th day.

*The Preventol CMK is p-chlor-m-cresol.

EXAMPLE 3

Both sides of a freshly flayed, unwashed cattle hide piece were sprayed with an aqueous mixture of 10% by mass of cyanamide, 0.1% by mass of Preventol CMK and 40% by mass of glycerol. The hide piece was stored the same way as in Example 1. A mild hairslip was observed on the 180th day and the odour of putrefaction appeared on the 205th day.

EXAMPLE 4

A freshly flayed, unwashed cattle hide piece was soaked for 5 minutes in an aqueous mixture containing 25% by mass of cyanamide, 2% by mass of sodium dihydrogen phosphate and 0.1% by mass of Preventol CMK. After dripping off the excess solution the hide piece was stored under the same conditions as in Example 1. Mild harslip appeared after the 200th day and the odour of putrefaction after the 230th day.

EXAMPLE 5

A piece of freshly flayed cattle hide was soaked for 5 minutes in a 0.1% by mass of cyanamide solution and then it was dried at ambient temperature for two days until it lost 40% of its original moisture content. Then the hide piece was put into a plastic bag and was stored at ambient temperature. No signs of putrefaction appeared during the first two months of storage. Another hide treated with a 0.5% by mass cyanamide solution was in good condition even after 10 months.

EXAMPLE 6

Fine saw dust was impregnated with a solution containing 15% by mass of cyanamide. Freshly flayed cattle hide pieces were then covered with the thus-treated saw dust and were stored at ambient temperature for 48 days without any sign of deterioration.

What we claim is:

1. A process for preserving untanned freshly flayed animal hides and skins which comprises: treating said hides or skins with an aqueous solution containing at least 0.1% by volume of cyanamide.

2. The process of claim 1, wherein the solution further contains sodium chloride.

3. The process of claim 1, wherein the solution further contains one or more polyalcohols, fungicides, buffer systems possessing buffer capacity in acidic media, salts capable of acidic hydrolysis, weak acids and surface active agents.

4. The process of claim 1, wherein the hides or skins are soaked in said solution.

* * * * *